US005999135A

United States Patent [19]

Nozaki et al.

[11] Patent Number: 5,999,135

[45] Date of Patent: Dec. 7, 1999

[54] GLASS ANTENNA SYSTEM FOR VEHICLES

[75] Inventors: Toru Nozaki; Hiroyuki Fujii, both of Matsusaka, Japan

[73] Assignee: Central Glass Company, Limited, Yamaguchi, Japan

[21] Appl. No.: 09/120,735

[22] Filed: Jul. 23, 1998

[30] Foreign Application Priority Data

Jul. 25, 1997 [JP] Japan ..... 9-199902
Dec. 2, 1997 [JP] Japan ..... 9-332211

[51] Int. Cl.[6] ..... H01Q 1/32

[52] U.S. Cl. ..... 343/713; 343/860

[58] Field of Search ..... 343/704, 713, 343/850, 852, 860; H01Q 1/32

[56] References Cited

U.S. PATENT DOCUMENTS

| | | | |
|---|---|---|---|
| 5,083,134 | 1/1992 | Saitou et al. | 343/713 |
| 5,198,825 | 3/1993 | Sakurai et al. | 343/713 |
| 5,239,302 | 8/1993 | Maeda et al. | 343/713 |
| 5,654,720 | 8/1997 | Saitou et al. | 343/713 |

FOREIGN PATENT DOCUMENTS

| | | |
|---|---|---|
| 43 12 259 | 10/1994 | Germany . |
| 2-72010 | 6/1990 | Japan . |
| 7-111412 | 4/1995 | Japan . |

*Primary Examiner*—Don Wong
*Assistant Examiner*—Tan Ho
*Attorney, Agent, or Firm*—Evenson, McKeown, Edwards & Lenahan, PLLC

[57] ABSTRACT

An antenna system for a vehicle is provided. The antenna comprises an antenna disposed on a window glass and having a feed point, a matching circuit connected to the feed point, and a coaxial cable connecting between the matching circuit and the radio receiver. The matching circuit includes a parallel circuit having a damping resistor, a first coil and a first capacitor. The matching circuit further includes a second coil and a second capacitor connected in series between an output side of the parallel circuit and a ground such that, assuming that MF1 is a lower limited frequency of medium-frequency (MF) broadcast waves and MF2 is an upper limited frequency of the MF broadcast waves, a receiving sensitivity of the antenna system has local maximum points which are present at a frequency F1 in the range from (MF1−170) to MF1 KHz and at a frequency f2 in the range from (MF2−230) to MF2 KHz, respectively, and a local minimum point which is present at a frequency f0 smaller than f1 and equal to or larger than 50 KHz.

7 Claims, 6 Drawing Sheets

GLASS ANTENNA SYSTEM FOR VEHICLES

BACKGROUND OF THE INVENTION

1. Field of the Invention

The present invention relates to a glass antenna system provided to a vehicle rear window or vehicle side window glass for receiving AM radio and LF (low frequency) radio broadcast waves, particularly of the kind which can attain good reception of AM radio broadcast waves without a pre-amplifier.

2. Description of the Related Art

In recent years, there is an increasing demand for a vehicle glass antenna for receiving AM and FM radio broadcast waves and television (TV) broadcast waves. To this end, antenna conductive strips are installed on a vehicle rear window glass together with defogging heater strips. However, since such an antenna is disposed in a space left above or below an array of defogging heater strips, an area of space permitted for disposition of the antenna is inevitably small, thus causing a problem that it is difficult to make the receiving sensitivity higher. Further, the antenna must be disposed so close to the vehicle body that the broadcast waves received by the antenna may be leaked to a vehicle body or to a ground side and a DC power source by way of a power supply line for heating. To prevent such leakage, a pre-amplifier or the like is disposed between a receiver and a feed point of the antenna. This arrangement however results in an increased cost and furthermore has a possibility of causing cross modulation when used in a strong electric field. For this reason, an effort has been made for seeking after an antenna which can attain a good receiving sensitivity without using a pre-amplifier. As a result of such an effort, there has been proposed an antenna for improving a receiving sensitivity over all of AM broadcast bands as disclosed in Japanese utility model provisional publication No. 2-72010 or Japanese patent provisional publication No. 7-111412.

In the receiver disclosed in Japanese utility model provisional publication No. 2-72010, attention is paid only to AM broadcast band and a matching circuit is provided within the band for canceling a floating capacity portion-to-ground which is present when an antenna side is observed from an input end of a tuner and thereby improving the receiving sensitivity. In the antenna system disclosed in Japanese Patent provisional publication No. 7-111412, resonance points are present both at the in-band and out-band with a view to improving the receiving sensitivity for AM radio broadcast waves. However, neither of the receiver and the antenna system are structured so as to positively make a local minimum point be present in an adjacent low-frequency side out-band region, so interference by the adjacent out-band waves cannot be avoided.

Further, the both are not adapted so that a similar minimum point is present on a shortwave or low-frequency (LF) band side outside the above described broadcast band and thus suffers interference if a disturbing signal (the disturbing signal is also called an image frequency interference signal) is present in the frequency which is higher than a target receive frequency by twice as high as an intermediate frequency (450 KHz), which is a characteristic phenomenon of a superheterodyne receiver. Thus, when a disturbing signal is present in the frequency range from 1420 to 2530 KHz which is the result of addition of 900 KHz to the receive frequency in the range from 520 to 1630 KHz in Japan, the receiver and antenna system disclosed in the above described Japanese Patent provisional publications cannot avoid an interference.

SUMMARY OF THE INVENTION

According to a first aspect of the present invention, there is provided, as shown in FIGS. 1 to 4, a novel and improved glass antenna system for a vehicle having a window glass and a radio receiver. The glass antenna system comprises an antenna disposed on the window glass and having a feed point, a matching circuit connected to the feed point, and a coaxial cable connecting between the matching circuit and the radio receiver. The matching circuit includes a parallel circuit having a damping resistor, a first coil and a first capacitor. The matching circuit further includes a second coil and a second capacitor connected in series and disposed between an output side of the parallel circuit and a ground such that, assuming that MF1 is a lower limited frequency of medium-frequency (mf) broadcast waves and MF2 is an upper limited frequency of the medium-frequency (mf) broadcast waves, as receiving sensitivity of the antenna system has local maximum points which are present at a frequency f1 in the range from (MF1−170) to MF1 KHz, i.e., in the frequency range from 350 to 520 KHz in Japan, and at a frequency f2 in the range from (MF2−230) to MF2 KHz, i.e., in the frequency range from 1400 to 1630 KHz in Japan, respectively, and a local minimum point which is present at a frequency f0 smaller than said frequency f1 and equal to or larger than 50 KHz. The matching circuit produces a series resonance with the floating capacity-to-ground of the antenna at a frequency f2 adjacent an upper limited frequency of AM radio broadcast waves, i.e., 1630 KHz and in the frequency range from 1400 to 1630 KHz in Japan, i.e., within the AM radio broadcast band in Japan, for thereby making the receiving sensitivity have a local maximum. Further, the matching circuit produces a series resonance with the floating capacity-to-ground of the coaxial cable at a frequency f1 in a band adjacently outside the AM radio broadcast band and including a lower limited frequency of the AM radio broadcast band, i.e., 520 KHz and in the range from 350 to 520 KHz in Japan, i.e., outside the AM radio broadcast band in Japan, for thereby making the receiving sensitivity have a local maximum.

Since the glass antenna has such a characteristic that its receiving sensitivity becomes higher as a frequency of its receiving wave becomes higher, not to speak of an ordinary antenna, it is structured such that the receiving sensitivity for a receiving wave of a lower frequency is higher than that for a receiving wave of a higher frequency. For this reason, when the frequency f1 where the local maximum on the lower frequency side is present is within the AM radio broadcast band, there is a possibility that a noise of a harsh, jarring or grating sound becomes larger. Thus, the antenna system of this invention is adapted so that a local maximum of the receiving sensitivity is present at a frequency f1 between a lower limited frequency of the AM radio broadcast waves and a frequency lower than that lower limited frequency. Though the frequency f1 is outside the AM radio broadcast band, it is adjacent that band. Thus, by the local maximum at the above described frequency f2 and the local maximum at the above described frequency f1, the receiving sensitivity over all of the AM broadcast band is improved.

Further, by constructing the antenna system so that a local minimum point of the receiving sensitivity is present at a frequency f0 which is lower than f1 and equal to or higher than 50 KHz, it becomes possible to decrease interference due to waves outside the AM radio broadcast band and on the adjacent low-frequency band side thereof.

It is more preferable to construct the antenna system so that its receiving sensitivity has a local minimum point at the frequency f3.

The antenna system suffers interference if a disturbing signal (the disturbing signal is also called an image frequency interference signal) is present in the frequency which is higher than a target receive frequency by twice as high as an intermediate frequency (450 KHz), which is a characteristic phenomenon of a superheterodyne receiver. Thus, when a disturbing signal is present in the frequency range from 1420 to 2530 KHz in Japan, which is the result of addition of 900 KHz to the receive frequency in the range from 520 to 1630 KHz in Japan, it is inevitable for the antenna system to suffer interference. Thus, by constructing the antenna system so that a local minimum point of the receiving sensitivity is present at a frequency in the range at least excluding a range up to the upper limited frequency of the AM radio broadcast band, i.e., in the range from 1630 to 2530 KHz in Japan, it becomes possible to decrease mixing of a disturbing signal.

Further, by a series resonance by the provision of a third coil L13 and a third capacitor C13 (refer to FIG. 3), it becomes possible to provide the receiving sensitivity with a local minimum point at a frequency f4 (refer to FIG. 4) higher than the frequency f3, whereby it becomes possible to make further larger the damping degree for the frequency range from 1630 to 2530 KHz in Japan and more decrease interference due to an image frequency interference signal which is characteristic of the superheterodyne receiver.

By constructing the matching circuit so that an electrostatic capacity of the first capacitor is in the range from 20 to 300 pF, an electrostatic capacity of the second capacitor is in the range from 300 pF to 0.02 $\mu$F, an inductance of the first coil is in the range from 20 to 150 $\mu$H, and an inductance of the second coil is in the range from 300 to 850 $\mu$H, the receiving sensitivity can have local maximum values at the frequencies f1 and f2 and local minimum points at the frequencies f0 and f3 as described above.

The vehicle window glass on which a conductive strip of the antenna is disposed, is not limited to such a side window glass as described and shown in the embodiment but can be a rear window glass or a windshield. In case the antenna is formed on the rear window glass, it can be disposed in a marginal space of the window glass above or below a defogging heater element which is formed by printing a silver paste onto the window glass.

The antenna is not limited to a print antenna which is formed by printing a silver paste onto a window glass and baking it as described in the embodiment, but can be modified to various antennas such as an antenna formed from a transparent conductive film and a wire antenna including a thin metal wire of Cu or the like which is embedded in an intermediate film.

The matching circuit at least includes a parallel circuit consisting of a damping resistor, a first coil and a first capacitor, and a pair of a second coil and a second capacitor which is disposed between the parallel circuit and a ground. As shown in the embodiment, a regulating resistor may be incorporated in parallel with the second coil.

The first coil produces a series resonance with the floating capacity of the antenna at the frequency f2 so that maximum current flows through the first coil, i.e., maximum current is supplied to the receiver, while producing a parallel resonance with the first capacitor at the frequency f3 so that the impedance of the parallel circuit becomes maximum for thereby allowing minimum current to flow through the parallel resonance circuit. By increasing the inductance in the range from 20 to 150 $\mu$H, the resonance points f2 and f3 can be made lower. On the other hand, by decreasing the inductance, the resonance points f2 and f3 can be made higher.

The second coil produces a series resonance together with the second capacitor at the frequency f0 for thereby causing the impedance-to-ground to become minimum, while at the same time producing a parallel resonance together with the coaxial cable which connects between the matching circuit and the radio receiver, at the frequency f1 for thereby making the impedance-to-ground maximum (i.e., making the transmission loss minimum) so that current flowing into the receiver becomes maximum. By increasing the inductance in the range from 300 to 850 $\mu$H, the resonance points f0 and f1 can be made lower. On the other hand, by decreasing the inductance, the resonance points f0 and f1 can be made higher.

While the first and second coils have been described and shown as being separate coils, they can be replaced by a transformer coil consisting of a single iron core and first and second coils wound around the iron core.

The first capacitor not only produces a parallel resonance with the first coil at the frequency f3 but becomes lower in the impedance for the FM radio broadcast waves so as to serve as a bypass capacitor. By making larger the electrostatic capacity of the first capacitor in the range from 20 to 300 pF, the resonance points f2 and f3 can be made lower. On the other hand, by making smaller the electrostatic capacity, the resonance points f2 and f3 can be made higher.

The second capacitor not only produces a series resonance with the second coil but can make the resonance points f0 and f1 higher or lower. By making larger the electrostatic capacity in the range from 300 pF to 0.01 $\mu$F, the resonant points f0 and f1 can be made lower. On the other hand, by making smaller the electrostatic capacity, the resonant points f0 and f1 can be made higher.

By making lower Q of the parallel resonance circuit consisting of the first capacitor and the first coil, in the range from 1 to 100 KΩ, the band width and the phase characteristic can be improved.

The regulating resistor is not always necessitated but enables regulation of the receiving sensitivity, so a resistor in the range from 10 to 100 KΩ can be provided for this end according to the necessity.

The third coil L13 is provided for producing a series resonance with the third capacity C13 at the frequency f4 for thereby minimizing the impedance to ground at the resonance point and further making wider the damping region, together with that at the frequency f3, by means of the third resistor R13 connected in series with the third capacitor C13. For this end, the third coil L13 can be in the range from 70 to 800 $\mu$H, the third capacitor C3 can be in the range from 5 to 50 pF, and the third resistor R13 can be in the range from 10 to 500 KΩ.

According to a second aspect of the present invention, there is provided, as shown in FIGS. 5 and 6, another glass antenna system for a vehicle having a window glass and a radio receiver. The glass antenna system comprises an antenna disposed on the window glass and having a feed point, a matching circuit connected to the feed point, and a coaxial cable connecting between the matching circuit and the radio receiver. The matching circuit includes a first coil L21 operative to produce a series resonance with a floating capacity C0 between a conductive strip of the antenna and a ground, a first resistor R21 connected in parallel to the first coil L21, a second coil L22 operative to produce a series resonance with the floating capacity C0 between the antenna and the ground, by way of a first capacitor C21, a pair of a second capacitor C22 and a second resistor R22 connected in parallel with the second coil L22, and a series-parallel circuit connected between a junction of the first capacitor C21 and the second coil L22, etc. and the ground. The series-parallel circuit includes a parallel circuit having a third coil L23 and a third resistor R23, and a third capacitor C23 connected in series to the parallel circuit. The matching circuit further includes a series circuit having a fourth coil L24 and a fourth capacitor C24 and connected between a junction of the second resistor R22, etc. and the coaxial cable 4 and the ground such that, assuming that LF1 is a lower limited frequency of low-frequency broadcast waves, LF2 is an upper limited frequency of the low-frequency broadcast waves, MF1 is a lower limited frequency of medium-frequency broadcast waves, MF2 is an upper limited frequency of the medium-frequency broadcast wave, F0 is a frequency in the range from 50 to (LF1−20) KHz, F1 is a frequency in the range from LF1−60) to (LF1+10) KHz, F2 is a frequency in the range from LF2−30 ) to LF2+50) KHz, F3 is a frequency in the range from (LF2+20) to (MF1−20) KHz. F4 is a frequency in the range from (MF1−130) to MF1 KHz, F5 is a frequency in the range from (MF2−230) to MF2 KHz, and F6 is a frequency in the range from MF2 to (MF2+100) KHz, a receiving sensitivity of the antenna system has local maximum points at F1, F2, F4 and F5 and local minimum points at F0, F3 and F6, respectively.

In the glass antenna system according to the second aspect, the constant value of each element can be in the range as follows, i.e., the first resistor R21 is in the range from 1 to 20 KΩ, the second resistor R22 is in the range from 1 to 20 KΩ, the third resistor R23 is in the range from 10 to 300 KΩ, and the first coil L21 is in the range from 100 to 350 μH, the second coil L22 is in the range from 30 to 100 μH, the third coil L23 is in the range from 1 to 5 mH, the fourth coil L24 is in the range from 750 μH to 2 mH, the first capacitor C21 is in the range from 500 to 200 pF, the second capacitor C22 is in the range from 50 to 500 pF, the third capacitor C23 is in the range from 500 to 300 pF, and the fourth capacitor C24 is in the range from 50 to 500 pF.

Assuming that MF1 is the lower limited frequency of the medium-frequency (MF) broadcast waves (522 KHz in Japan and 531 KHz in Europe) and MF2 is the upper limited frequency of the MF broadcast waves (1629 KHz in Japan and 1602 KHz in Europe), the matching circuit produces a parallel resonance with the floating capacity C0 between the conductive strip of the antenna and the ground and the floating capacity C3 between the coaxial cable and the ground at the frequency F4 adjacent the lower limited frequency of the MF broadcast band and in the range from (MF1−130) to MF1 KHz, while producing a series resonance with the conductive strip of the antenna and the ground at the frequency F5 adjacent the upper limited frequency of the MF broadcast band and in the range from (MF2−230) to MF2 KHz, for thereby causing local maximum points of the receiving sensitivity at the respective frequencies and making higher the reception gains over all the MF broadcast band. Further, assuming that LF1 is the lower limited frequency of the low-frequency (LF) broadcast waves (153 KHz in Europe) and LF2 is the upper limited frequency of the LF broadcast waves 279 KHz in Europe), the matching circuit produces a parallel resonance with the floating capacity C0 between the conductive strip of the antenna and the ground and the floating capacity C3 between the coaxial cable and the ground at the frequency F1 adjacent the lower limited frequency of the LF broadcast waves and in the range from (LF1−60) to (LF1+10) KHz, while producing a series resonance with the floating capacity C0 between the conductive strip of the antenna and the ground at the frequency F2 adjacent the upper limited frequency of the LF broadcast wave and in the range from LF2−30) to (LF2+50) KHz, for thereby causing local maximum points of the receiving sensitivity at the respective frequencies and making higher the reception gains over all the LF broadcast band.

For the reason described above, when the frequency F4 where the local maximum for the lower frequency is present is within the AM radio broadcast band, there is a possibility that a noise of a harsh, jarring or grating sound becomes larger. Thus, it is adapted so that the local maximum is present at the frequency F4 in the range which is the lower limited frequency MF1 of the MF broadcast waves. Though the frequency F4 is outside the MF broadcast band, it is adjacent that band. Thus, by the local maximum at the frequency F4 and the local maximum at the upper limited frequency of the MF broadcast band or at the frequency F5 adjacent thereto, the receiving sensitivity over all of the MF broadcast band is improved.

Further, by constructing the glass antenna system so that a local minimum point of the receiving sensitivity is present at the frequency F3 in the range from (LF2+20) to (MF1−20), it becomes possible to decrease interference due to waves on the adjacent low-frequency band side at the time of reception of the medium-frequency (MF) broadcast and interference due to waves on the adjacent medium-frequency (MF) broadcast band at the time of reception of the LF broadcast.

Further, by constructing the glass antenna so that a local minimum point of the receiving sensitivity is present at the frequency F6 in the range from MF2 to (MF2+1000) KHz, it becomes possible to decrease mixing of a disturbing signal.

As described above, the antenna system suffers interference if a disturbing signal (the disturbing signal is also called an image frequency interference signal) is present in the frequency which is higher than a target receive frequency by twice as high as an intermediate frequency (450 KHz), which is a characteristic phenomenon of a superheterodyne receiver. Thus, when a disturbing signal is present in the frequency range from (MF1+900) to (MF2+900) KHz (1422–2529 KHz in Japan and 1431–2502 KHz in Europe) which is the result of addition of 900 KHz to the MF receive frequency (522–1629 KHz in Japan and 531–1602 KHz in Europe), it is inevitable for the antenna system to suffer interference. Thus, by constructing the glass antenna system so that a local minimum point of the receiving sensitivity is present at a frequency in the range at least excluding a range up to the upper limited frequency MF2 of the MF broadcast band and higher than MF2, i.e., in the range from MF2 to (MF2+1000) KHz, it becomes possible to decrease mixing of a disturbing signal.

Since two local maximum points of the receiving sensitivity are present at the frequency adjacent the lower limited frequency and the upper limited frequency of the LF broadcast waves as described above, the reception gains in receiving waves of LF broadcast which is given in Europe can be improved over all the LF broadcast band. Further, the local minimum point at the frequency F3 can decrease interference due to waves on the adjacent MF broadcast band side, and the local minimum point at the frequency F0 which is outside the LF broadcast band and adjacent the lower limited frequency thereof.

The first and second coils L21 and L22 are provided for producing a series resonance with the floating capacity C0 between the conductive strip of the antenna and the ground and the floating capacity C3 between the coaxial cable and the ground at the respective frequencies F2 and F3 so that the signal current flowing through the coaxial cable becomes maximum, i.e., a maximum signal current is supplied to the receiver. For this end, the first and second coils L21 and L22 can be in the range from 100 to 350 μH and in the range from 30 to 100 μH, respectively.

The third coil L23 is provided for producing a series resonance with the third capacitor C23 at the frequency F0 and thereby causing a local minimum point of the receiving sensitivity, and further for producing, together with the third capacitor C23, a parallel resonance with the floating capacity C0 between the conductive strip of the antenna and the ground and the floating capacitor C3 between the coaxial cable and the ground and thereby causing a local maximum point of the receiving sensitivity. For this end, the third coil L23 can be in the range from 1 to 5 mH.

The fourth coil L24 is provided for producing a series resonance with the fourth capacitor C24 at the frequency F3 and thereby causing a local minimum point of the receiving sensitivity, and further for producing, together with the fourth capacitor C24, a parallel resonance with the floating capacity C3 between the coaxial cable and the ground and the floating capacity C0 between the conductive strip of the antenna and the ground at the frequency F4 and thereby causing a local maximum point of the receiving sensitivity. For this end, the fourth coil L24 can be in the range from 750 μH to 2 mH.

The first capacitor C21 is a bypass capacitor and provided for producing a parallel resonance mainly with the first coil L21 and second coil L22 at the frequency F3 and thereby causing a local minimum point of the receiving sensitivity. For this end, the first capacitor C21 can be in the range from 500 to 2000 pF.

The second capacitor C22 is provided for producing a parallel resonance mainly with the second coil L22 at the frequency F6 and causing a local minimum point of the receiving sensitivity. For this end, the second capacitor C22 can be in the range from 50 to 500 pF.

The third capacitor C23 is provided for producing a series resonance with the third coil L23 at the frequency F0. The third capacitor C23 can be in the range from 500 to 3000 pF.

The fourth capacitor C24 is provided for a series resonance with the fourth coil L24 at the frequency F3. The fourth capacitor C24 can be in the range from 50 to 500 pF.

The resistors R21, R22 and R23 are all damping resistors and provided for adjustment of the magnitude of the local maximum point at the frequency F2, the magnitude of the local maximum point at the frequency F5, and the magnitudes of the local maximum points at the frequencies F1 and F4, respectively. For this end, the resistors R21, R22 and R23 are in the range from 1 to 20 KΩ, in the range from 1 to 20 KΩ, and in the range from 10 to 300 KΩ, respectively.

The above structure is effective for solving the above noted problems inherent in the prior art device.

It is accordingly an object of the present invention to provide a novel and improved vehicle glass antenna system which can prevent interference in the band on the adjacent low-frequency (LF) band side and reduce disturbance due to an image frequency interference signal of a super heterodyne receiver while making higher the receiving sensitivity over all the AM radio broadcast band (medium-frequency broadcast band) and being capable of receiving LF broadcast band waves and VHF band waves such as FM radio broadcast band waves.

DETAILED DESCRIPTION OF THE PREFERRED EMBODIMENTS

Figure 1:
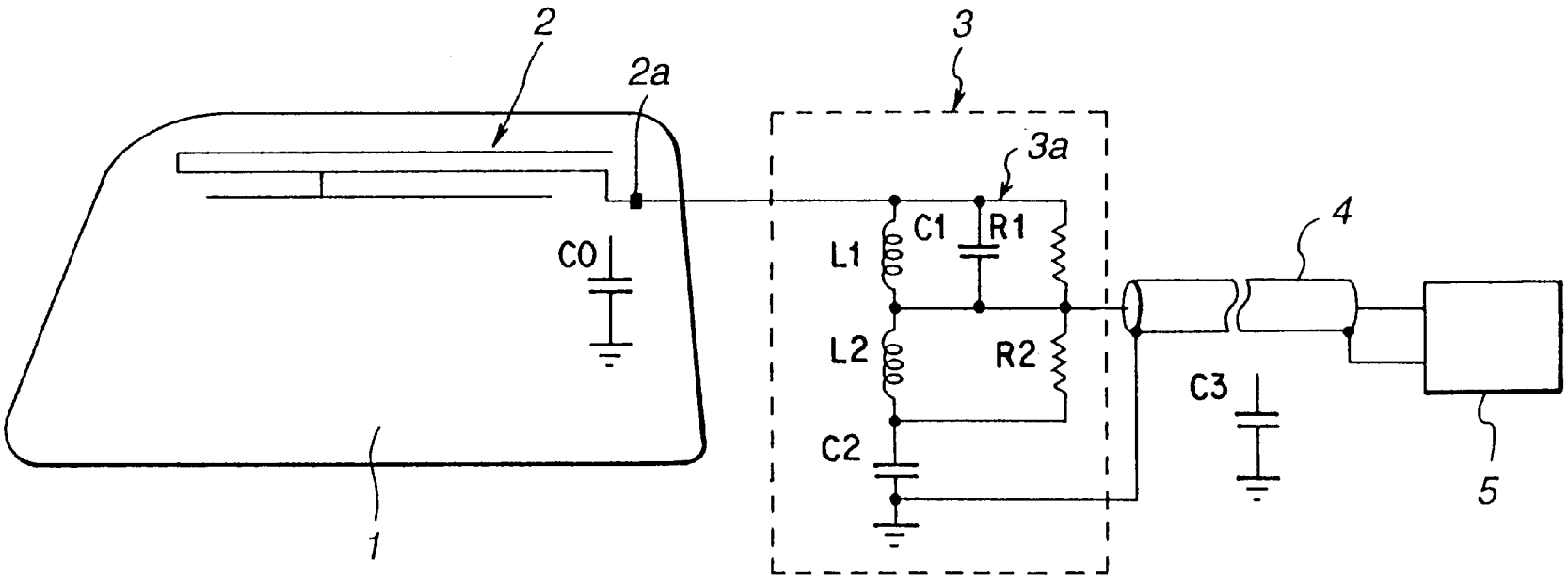
FIG. 1 is a diagrammatic view of a glass antenna system according to an embodiment of the present invention.

FIG. 1 shows an automobile side window glass in which the present invention is embodied. A glass plate 1 is used as the side window glass. An antenna 2 is disposed on the inboard surface of the glass plate 1 and has a feed point 2*a*. The antenna 2 is a conductive strip which is formed by screen printing a conductive silver paste onto the glass surface and, after drying, baking the glass plate with the printed paste thereon.

After installation of the side window formed with the antenna 2 on an automobile, the antenna 2 is connected to a radio receiver 5 by way of a matching circuit 3 and by means of a coaxial cable 4. That is, the matching circuit 3 is connected at an input side thereof to the feed point 2*a* of the antenna 2 and at an output side thereof to the radio receiver 5 by way of the coaxial cable 4.

The matching circuit 3 includes a parallel circuit 3*a* consisting of a damping resistor R1 of 5 KΩ, a first coil L1 of 80 μH and a first capacitor C1 of 150 pF. The matching circuit 3 further includes a second coil L2 of 450 μH and a second capacitor C2 of 6000 pF which are connected in series and a regulating resistor R2 of 50 KΩ in parallel with the second coil L2 and in series with the second capacitor C2. The second coil L2, second capacitor C2 and regulating resistor R2 are disposed between the output side of the parallel circuit 3*a* and the ground.

In the meantime, C0 represents a floating capacity-to-ground of the antenna 2, and C3 represents a floating capacity-to-ground of the coaxial cable 4.

With the antenna system structured as above, gains of the antenna 2 in receiving AM radio broadcast band and its adjacent band, i.e., radio waves in the frequency band from 80 KHz to 3.0 MHz were measured and compared with the gains of the comparative antenna system which is not provided with the matching circuit. That is, for any frequency, the gains of the comparative antenna system was taken as the basis, 0 dB, and the gain of the antenna system of this invention was marked on this basis. The results are shown in FIG. 2.

Figure 2:
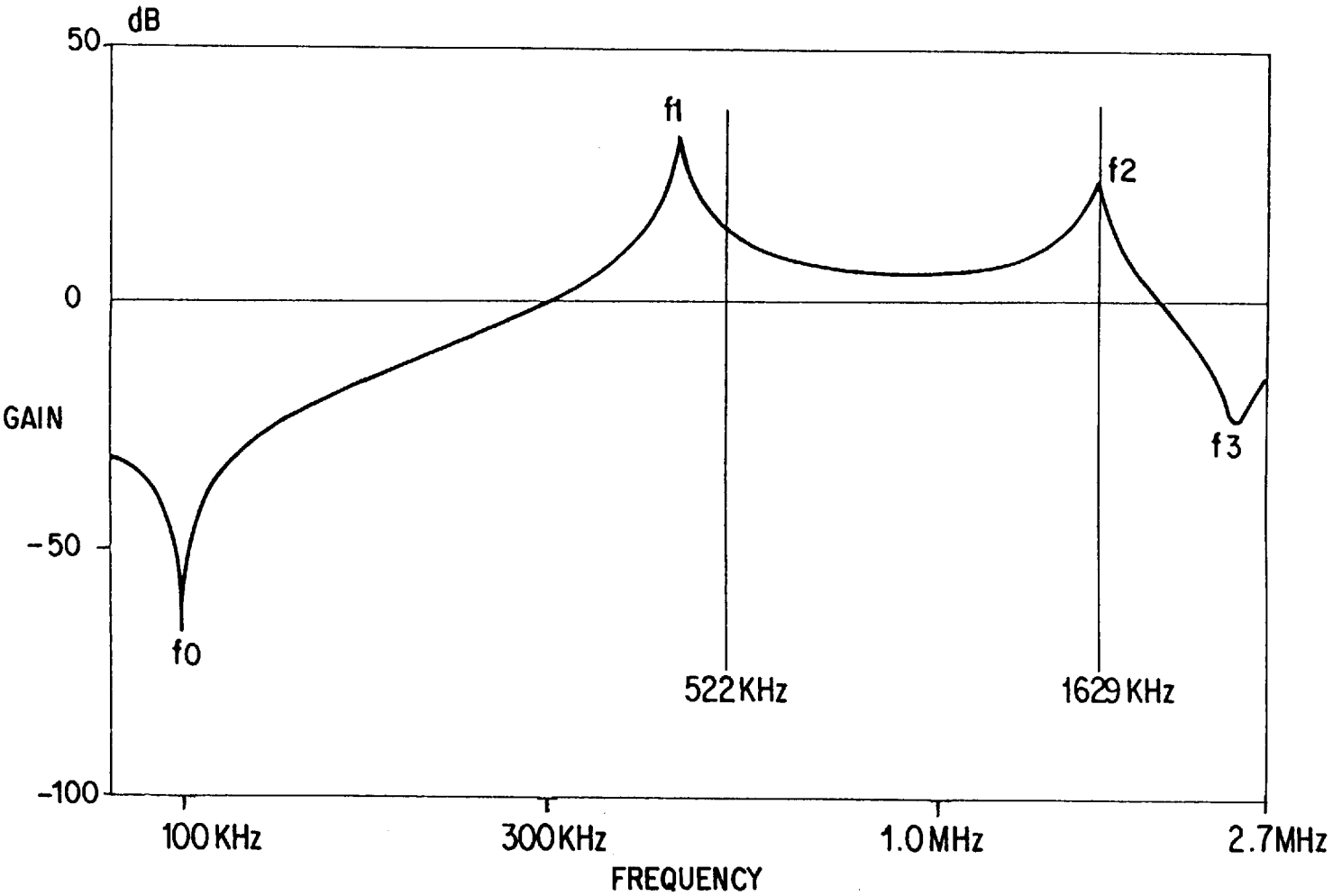
FIG. 2 is a frequency characteristic diagram showing a relation between frequency and receiving sensitivity of the glass antenna system of FIG. 1.

As will be apparent from FIG. 2, local minimum points of the receiving sensitivity are present nearly at 100 KHz (f0) and nearly at 2.6 MHz (f3), and local maximum points are present nearly at 450 KHz (f1) and nearly at 1570 KHz (f2). As a result, the gain is improved by about 10 dB in the AM radio broadcast band of 520–1630 KHz in Japan. Since an improved gain attained by a comparable prior art antenna system is assumed to be 5 dB or so, it will be understood that the improvement in the receiving sensitivity attained by the present invention is large.

Further, the S/N ratio is improved, on average, by about 4.5 dB in the broadcast band of 520–1630 KHz in Japan.

Further, the antenna system of this invention can also receive FM radio broadcast waves. In this connection, the impedance of the first capacitor C1 is so small as to be negligible as compared with the impedance of the first coil L1 and the damping resistor R1, so the first capacitor C1 serves as a bypass capacitor to enable reception with a small transmission loss.

The antenna system of the present invention prevents interference in the adjacent low-frequency band side region of the band and further reduces disturbance by a disturbing signal of a superheterodyne receiver, whereby to make it possible to make higher the receiving sensitivity over all of the AM radio broadcast band and the S/N ratio while making it possible to receive waves in the VHF band such as the FM radio broadcast band.

Figure 3:
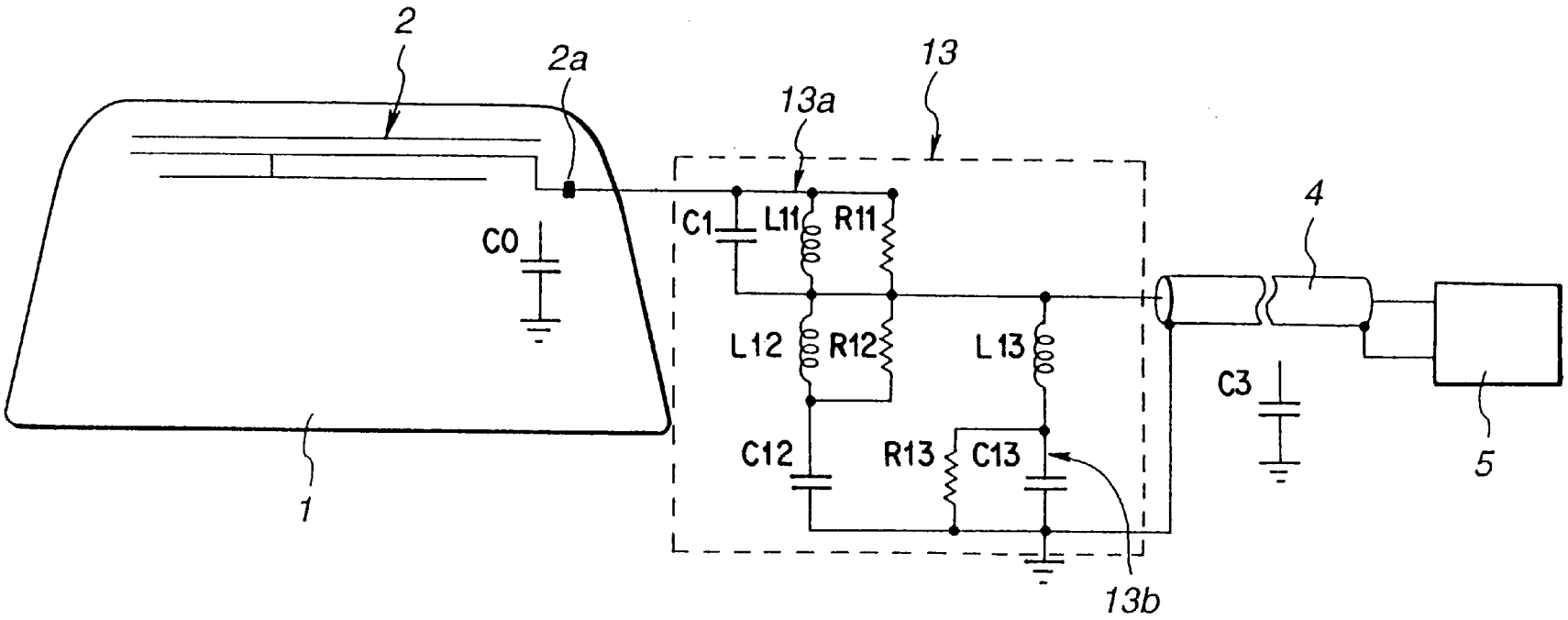
FIG. 3 is a view similar to FIG. 1 but shows another embodiment.

FIG. 3 shows a glass antenna system according to another embodiment.

The matching circuit 13 in this embodiment includes a parallel circuit 13*a* consisting of a damping resistor R11 of 8 KΩ, a first coil L11 of 80 μH and a first capacitor C11 of 60 pF. The matching circuit 13 further includes a second coil L12 of 430 μH and a second capacitor C12 of 6000 pF which are connected in series, and a regulating resistor R12 of 50 KΩ in parallel with the second coil L12 and in series with the second capacitor C12. The second coil L12, second capacitor C12 and regulating resistor R12 are disposed between an output side of the parallel circuit 13*a* and the ground. The matching circuit 13 yet further includes a series-parallel circuit 136 disposed between the output side of the parallel circuit 13*a* and the ground. The series-parallel circuit 13*b* includes a parallel circuit consisting of a third capacitor C13 and another resistor R13, and a third coil L13 connected in series with the parallel circuit.

With the glass antenna system structured as above, gains of the glass antenna system in receiving radio waves in AM broadcast band and its adjacent band, i.e., radio waves in the frequency band from 80 KHz to 3.0 MHz were measured and compared with the gains of the comparative antenna system which is not provided with the matching circuit. That is, for any frequency, the gains of the comparative antenna system was taken as the basis, 0 dB, and the gain of the antenna system of this invention was marked on this basis. The results are shown in FIG. 4.

Figure 4:
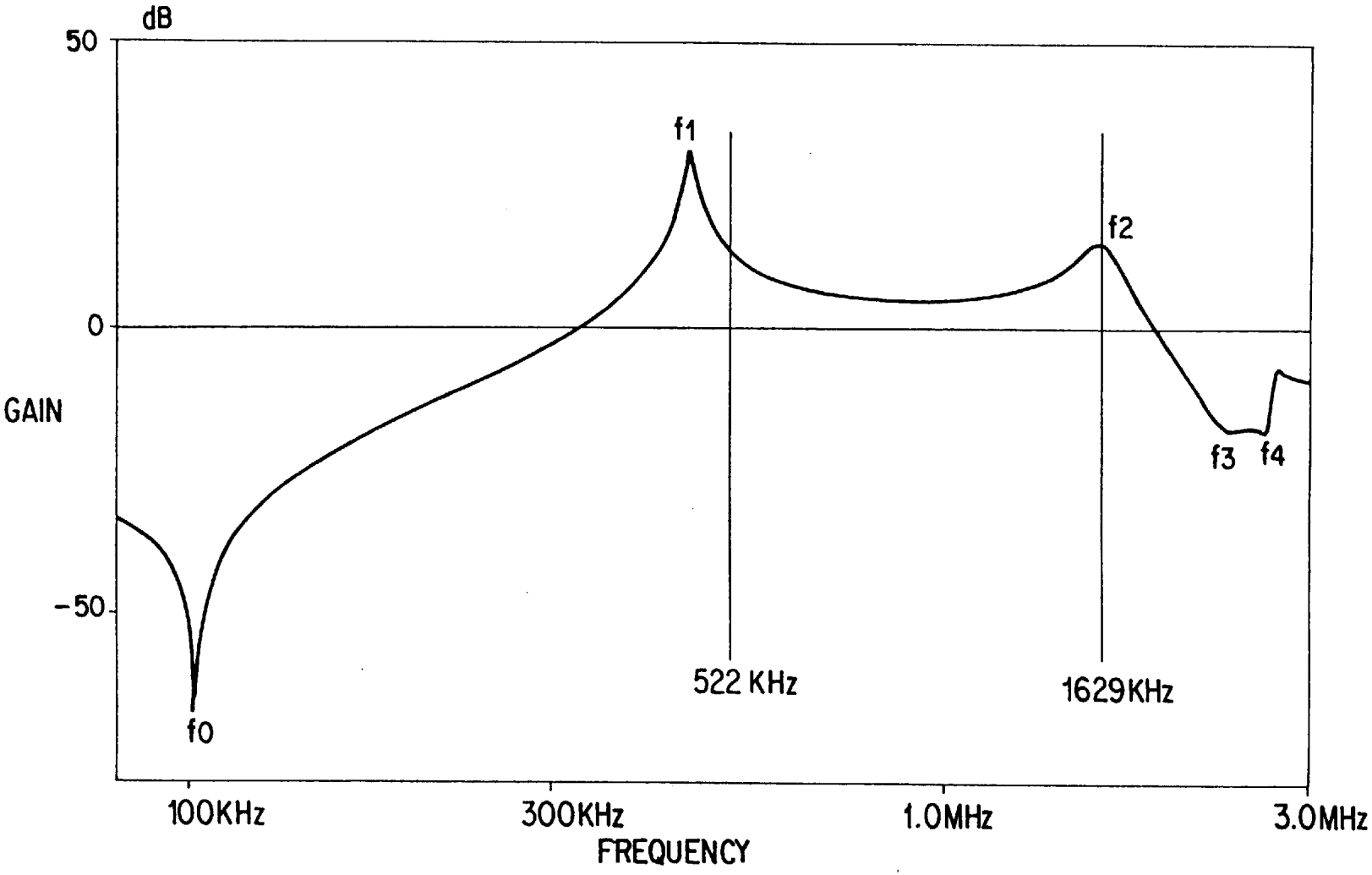
FIG. 4 is a frequency characteristic diagram showing a relation between frequency and receiving sensitivity of the glass antenna system of FIG. 3.

As will be apparent from FIG. 4, local minimum points of the receiving sensitivity are present nearly at 100 KHz (f0), 2.3 MHz (f3) and 2.6 MHz (f4), and local maximum points are present nearly at 450 KHz (f1) and 1570 KHz (f2). As a result, the gain is improved by about 10 dB in the AM radio broadcast band of 520–1630 KHz in Japan. Since an improved gain attained by a comparable prior art antenna system is assumed to be 5 dB or so, it will be understood that the improvement in the receiving sensitivity attained by the present invention is large.

Figure 5:
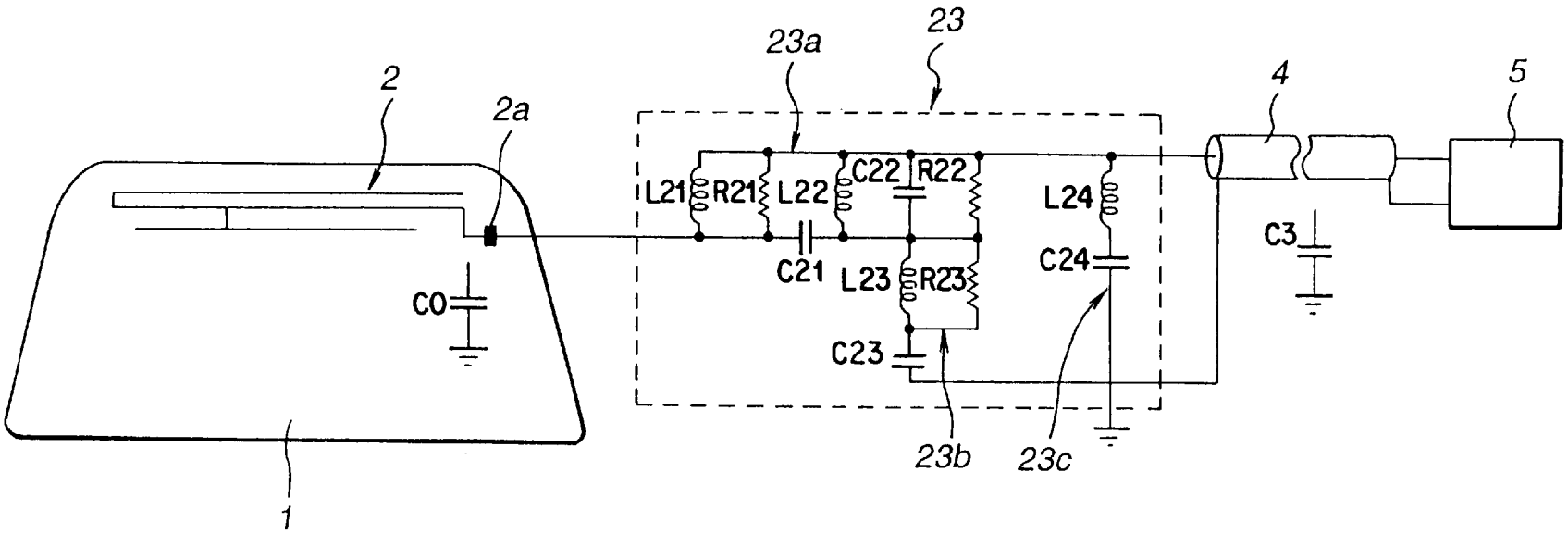
FIG. 5 is a view similar to FIG. 1 but shows a further embodiment.

FIG. 5 shows a glass antenna system according to a further embodiment.

The matching circuit 23 in this embodiment is made up of a series-parallel circuit and a series circuit. The series-parallel circuit includes a parallel circuit 23*a* consisting of a first coil L21 of 300 μH which is operative to produce a series resonance with a floating capacity C0 between the conductive strip of the antenna 2 and the ground, a first resistor R21 of 10 KΩ which is connected in parallel to the first coil L21, a second coil L22 of 55 μH which is operative to produce a series resonance with the floating capacity C0 between the conductive strip of the antenna 2 and the ground, by way of a first capacitor C21 of 700 pF, a pair of a second capacitor C22 of 160 pF and a second resistor R22 of 5 KΩ connected in parallel with the second coil L22, a series-parallel circuit 23*b* connected between the junction of the first capacitor C21 and the second coil L22, etc., and a series circuit 23*c* connected between the junction of the second resistor R22 and the coaxial cable 4, etc., and the ground. The series-parallel circuit 23*b* includes a parallel circuit consisting of a pair of third coil L23 of 3.2 mH and a third resistor R23 of 15 KΩ, and a third capacitor C23 of 2500 pF connected in series with the parallel circuit of the third coil L23 and the third resistor R23. The series circuit 23C includes a pair of a fourth coil L24 of 1.5 mH and a fourth capacitor C24 of 100 pF.

With the antenna system structured as above, gains of the antenna 2 in receiving radio waves in the band from the low-frequency band to the medium-frequency band, i.e., in the frequency range from 50 to 300 KHz were measured and compared with the gains of the comparative antenna system which is not provided with the matching circuit. That is, for any frequency, the gains of the comparative antenna system was taken as the basis, 0 dB, and the gain of the antenna system of this invention was marked on this basis. The results are shown in FIG. 6.

Figure 6:
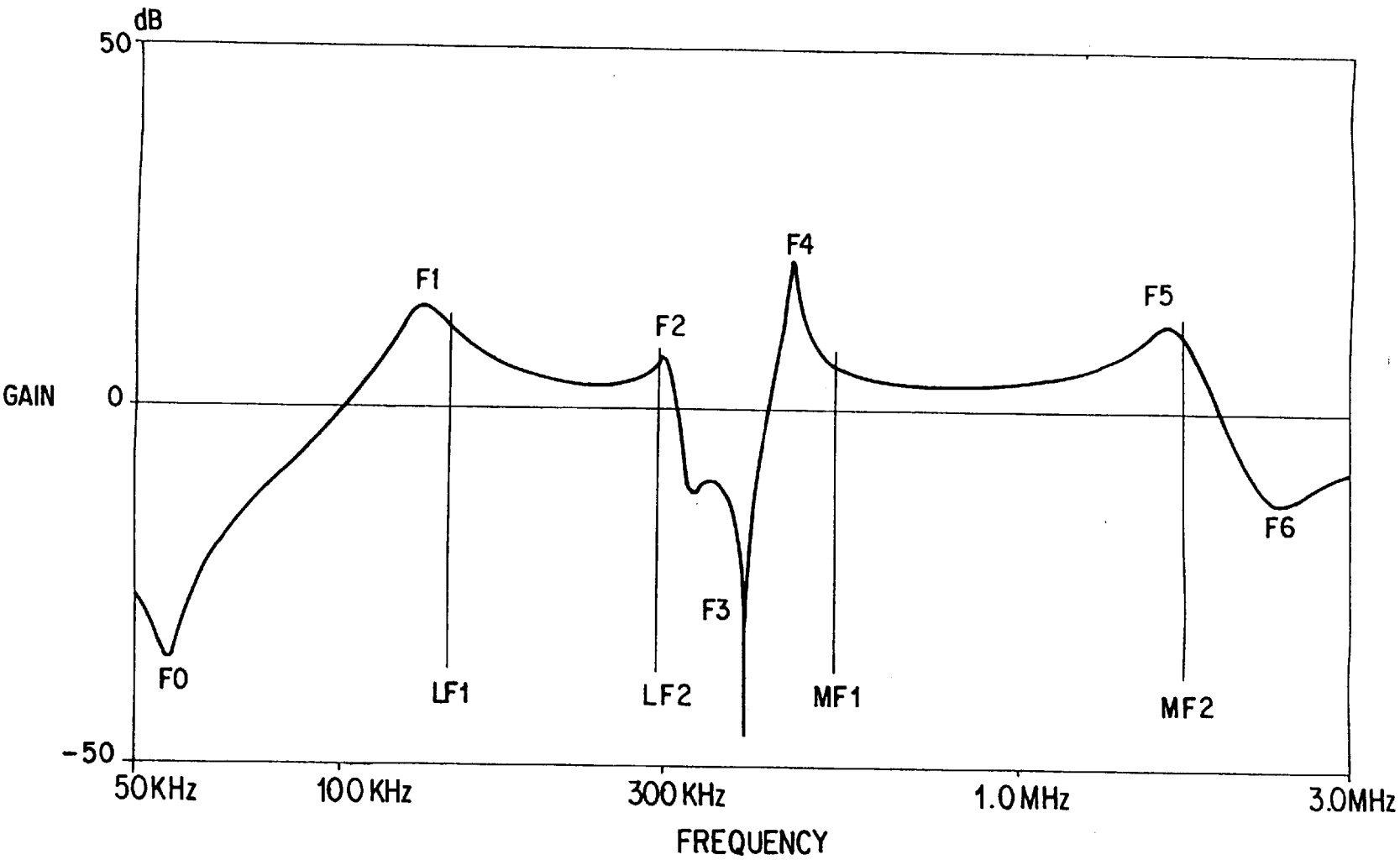
FIG. 6 is a frequency characteristic diagram showing a relation between frequency and receiving sensitivity of the glass antenna system of FIG. 5.

As will be apparent from FIG. 6, local minimum points of the receiving sensitivity are present nearly at 60 KHz (F0), 380 KHz (F3) and 2500 KHz (F6), and local maximum points are present nearly at 130 KHz (F1), 300 KHz (F2), 460 (F4) and 1600 KHz (F5). As a result, the gain is improved, on average, by about 7 dB in receiving low-frequency broadcast waves in Europe (153–279 KHz), and also improved, on average, by about 7 dB in receiving medium-frequency broadcast waves either in Europe (531–1602 KHz) and in Japan (522–1629 KHz). Since an improved gain attained by a comparable prior art antenna system is assumed to be 5 dB or so, it will be understood that the improvement in the receiving sensitivity attained by the present invention is large.

Further, the S/N ratio is improved, on average, by about 4 dB in the band of 522–1629 KHz.

Further, the antenna system of this invention can also receive FM radio broadcast waves. In this connection, the impedance of the first capacitor C21 and second capacitor C22 is so small as to be negligible as compared with the impedance of the first coil L21, second coil L22, first damping resistor R21 and second damping resistor R22, so the capacitors C21 and C22 serve as bypass capacitors to enable reception with a small transmission loss.

Except for the above, this embodiment is substantially similar to the embodiment of FIGS. 1 and 2 and can produce substantially the same effect.

What is claimed is:

1. An antenna system for a vehicle having a window glass and a radio receiver, comprising:

an antenna disposed on the window glass and having a feed point;

a matching circuit connected to said feed point; and a coaxial cable connecting between said matching circuit and the radio receiver;

wherein said matching circuit includes a parallel circuit having a damping resistor, a first coil and a first capacitor, said matching circuit further including a second coil and a second capacitor connected in series and disposed between an output side of said parallel circuit and a ground such that, assuming that MF1 is a lower limited frequency of medium-frequency (MF) broadcast waves and MF2 is an upper limited frequency of the medium-frequency (MF) broadcast waves, a receiving sensitivity of the antenna system has local maximum points which are present at a frequency f1 in the range from (MF1−170) to MF1 KHz and at a frequency f2 in the range from (MF2−230) to MF2 KHz, respectively, and a local minimum point which is present at a frequency f0 smaller than said frequency f1 and equal to or larger than 50 KHz.

2. An antenna system according to claim 1, wherein said matching circuit is constructed such that the receiving sensitivity of the antenna system has a local minimum point at a frequency f3 in the range from MF2 to (MF2+1000) KHz.

3. An antenna system according to claim 1, wherein an electrostatic capacity of said first capacitor is in the range from 20 to 300 pF, an electrostatic capacity of said second capacitor is in the range from 300 pF to 0.01 μF, an inductance of said first coil is in the range from 20 to 150 μH, and an inductance of said second coil is in the range from 300 to 850 μH.

4. A glass antenna system according to claim 1, further comprising a series-parallel circuit connected between the output side of said parallel circuit and the ground, said series-parallel circuit including a second parallel circuit and a third coil connected in series with said second parallel circuit, and second parallel circuit including a third capacitor and another resistor, such that the receiving sensitivity of the antenna has minimum local points at frequencies f3 and f4 which are in the range from MF2 to (MF2+1000) KHz.

5. A glass antenna system according to claim 4, wherein an electrostatic capacity of said first capacitor is in the range from 20 to 300 pF, an electrostatic capacity of said second capacitor is in the range from 300 pF to 0.01 μF, an electrostatic capacity of said third capacitor is in the range from 3 to 60 pF, an inductance of said first coil is in the range from 20 to 150 μH, an inductance of said second coil is in the range from 300 to 850 μH, and an inductance of said third coil is in the range from 70 to 800 μH.

6. A glass antenna system for a vehicle having a window glass and a radio receiver, comprising:

an antenna disposed on the window glass and having a feed point;

a matching circuit connected to said feed point; and a coaxial cable connecting between said matching circuit and the radio receiver;

wherein said matching circuit includes a first coil operative to produce a series resonance with a floating capacity between the antenna and a ground, a first resistor connected in parallel to said first coil, a second coil operative to produce a series resonance with the floating capacity between the antenna and the ground, by way of a first capacitor, a pair of a second capacitor and a second resistor connected in parallel with said second coil, and a series-parallel circuit connected between a junction of said first capacitor and said second coil and the ground, said series-parallel circuit including a parallel circuit having a third coil and a third resistor, and a third capacitor connected in series to said parallel circuit, said matching circuit further including a series circuit having a fourth coil and a fourth capacitor and connected between a junction of said second resistor and said coaxial cable and the ground such that, assuming that LF1 is a lower limited frequency of low-frequency broadcast waves, LF2 is an upper limited frequency of the low-frequency broadcast waves, MF1 is a lower limited frequency of medium-frequency broadcast waves, MF2 is an upper limited frequency of the medium-frequency broadcast waves, F0 is a frequency in the range from 50 to (LF1−20) KHz, F1 is a frequency in the range from (LF1−60) to (LF1+10) KHz, F2 is a frequency in the range from (LF2−30) to (LF2+50) KHz, F3 is a frequency in the range from (LF2+20) to (MF1−20) KHz, F4 is a frequency in the range from (MF1−130) to MF1 KHz, F5 is a frequency in the range from (MF2−230) to MF2 KHz, and F6 is a frequency in the range from MF2 to (MF2+1000) KHz, a receiving sensitivity of the antenna system has local maximum points at F1, F2, F4 and F5 and local minimum points at F0, F3 and F6, respectively.

7. A glass antenna system according to claim 6, wherein said first resistor is in the range from 1 to 20 KΩ, said second resistor is in the range from 1 to 20 KΩ, said third resistor is in the range from 10 to 300 ΩK, and said first coil is in the range from 100 to 350 μH, said second coil is in the range from 30 to 100 μH, said third coil is in the range from 1 to 5 mH, said fourth coil is in the range from 750 μH to 2 mH, said first capacitor is in the range from 500 to 2000 pF, said second capacitor is in the range from 50 to 500 pF, said third capacitor is in the range from 500 to 3000 pF, and said fourth capacitor is in the range from 50 to 500 pF.

* * * * *